US007475448B2

(12) United States Patent
Rosenzweig et al.

(10) Patent No.: US 7,475,448 B2
(45) Date of Patent: Jan. 13, 2009

(54) LIQUID DISPENSING DEVICE AND STEAM CLEANER CONTAINING SAME

(75) Inventors: Maximilian Rosenzweig, Cote St. Luc (CA); Semih Karahanoglu, Gebze (TR)

(73) Assignee: Euro-Pro Operating, LLP, West Newton, MA (US)

( * ) Notice: Subject to any disclaimer, the term of this patent is extended or adjusted under 35 U.S.C. 154(b) by 926 days.

(21) Appl. No.: 10/884,184

(22) Filed: Jul. 2, 2004

(65) Prior Publication Data

US 2006/0000048 A1 Jan. 5, 2006

(51) Int. Cl.
*A47L 5/14* (2006.01)

(52) U.S. Cl. ..... 15/320; 15/321; 15/322

(58) Field of Classification Search ..... 15/320, 15/321, 322, 414, 353
See application file for complete search history.

(56) References Cited

U.S. PATENT DOCUMENTS 4,327,459 A 5/1982 Gilbert
4,782,672 A * 11/1988 Secolo ..... 68/205 R
4,910,828 A * 3/1990 Blase et al. ..... 15/321
5,381,962 A * 1/1995 Teague ..... 239/526
5,996,649 A * 12/1999 Sutton et al. ..... 141/59
6,571,421 B1 6/2003 Sham et al.
D515,752 S * 2/2006 Rosenzweig ..... D32/18
2002/0112744 A1 8/2002 Besseling
2006/0000048 A1* 1/2006 Rosenzweig et al. ..... 15/320

FOREIGN PATENT DOCUMENTS

GB 1 449 483 9/1976

OTHER PUBLICATIONS

Euro-Pro Operating LLC; Steam Shark II Owner's Manual Model EP908EF; Nov. 2003; St. Laurent, Quebec H4S 1A7.

* cited by examiner

*Primary Examiner*—Lee D Wilson
(74) *Attorney, Agent, or Firm*—Greenberg Traurig, LLP; Michael I. Wolfson

(57) ABSTRACT

A liquid dispensing unit for a steam cleaner with a hand grip for dispensing steam is provided. The liquid dispenser injects a liquid, such as soap, into the steam to be applied to the dirt or stain to be removed. The dispenser includes a housing with at least one liquid cleaning agent tank adapted to fit onto the nozzle connection of the cleaner hand grip. The liquid dispensing unit includes a manually controlled pump for controlling the amount of liquid cleaning agent injected into the steam. The dispenser housing includes a nozzle end for receiving the same cleaning attachments that fit onto the hand grip.

12 Claims, 7 Drawing Sheets

LIQUID DISPENSING DEVICE AND STEAM CLEANER CONTAINING SAME

BACKGROUND OF THE INVENTION

The invention relates generally to a liquid dispensing device, and more particularly to a device for dispensing a controlled amount of liquid cleaner into a steam outlet of a steam cleaner.

Steaming devices used to apply steam to household objects are well known. The uses of the devices vary widely, and may include the application of steam to drapes or other fabrics to ease wrinkles, and the application of steam to objects to assist in cleaning the objects.

Typical steam devices have a reservoir for storing water with a heating element to heat the water. The heated water generates steam, which may be directed towards its intended destination through a nozzle which controls the application of the steam. Variation of the shape and size of the nozzle allows for preferred distribution of generated steam to an object to be cleaned. The nozzles may be disconnectable from the steam generator to allow different nozzles to be utilized, based on the object to be steamed. The nozzle may be either closely coupled to the steam generator, or located at a distance from the steam generator, requiring tubing or other steam transfer structures to be interconnected between the steam generator and the discharge nozzle. Typically, it is beneficial to provide suitable connectors between the steam generator and the nozzle to allow either the nozzle to be connected to the steam generator, or to allow the interpositioning of transfer tubes or hoses between the steam generator and the nozzle.

The use of steam alone sometimes is not sufficient to clean an object or surface where the dirt and/or stain to be removed is particularly resistant to cleaning i.e. blood, wine, grass, tea, coffee and the like. In these cases, a cleaning agent in addition to steam may help facilitate in the removal of the dirt and/or stain. Further, an unregulated amount of cleaning agent and steam decreases the efficiency of the removal of the dirt and/or stain. This is because some dirt and/or stains need to be pretreated with the cleaning agent before applying the steam for the dirt and/or stain removal or vice versa. In addition, other dirt and/or stains may need just steam to remove or dislodge the dirt and/or stain. The unregulated release of steam generated by a steam generator reduces the efficiency with which the device may be operated. Such inefficiency arises from the generation of excess steam when the steam is not being applied to an object to be steamed. These inefficiencies increase the operating cost of the device, and decreases the utility of the device.

The use of a cleaning agent and mixing it with steam to bring the mixture into contact with the dirt and/or stain to be removed is known in the art. However, such devices do not allow the user the option of applying the steam first to the object to be cleaned and then immediately applying a controlled amount of cleaning agent to the object to be cleaned. Further, the ratio of cleaning agent to steam needed for the removal of dirt and/or stain is not tailored by the user.

A combined steam and vacuum cleaner is shown in U.S. Pat. No. 4,327,459. Here, a steam hose and a detergent hose deposit steam and detergent on a surface to be cleaned adjacent to a vacuum hose. In this device, a water reservoir and a detergent reservoir are provided in a canister. Another variation of a combined steam and vacuum cleaner is shown in United States published application No. 2002/0112744. Here, a liquid cleaning agent is injected into a steam compartment that is then applied to the surface to be cleaned through a steam spray head. The steam and soap are then removed by a suction nozzle adjacent to the steam spray head. A steam cleaning apparatus providing for injection of a cleaning agent into a fluid conduit carrying a hot stream of water, steam and combustion gases to form a cleaning jet is shown in GB 1,449,483.

Notwithstanding the wide variety of steam generating appliances available, there exists the need to provide a self-contained liquid cleaning fluid dispenser device for use with a steam cleaner, particularly for a light-weight portable device suitable for household use. It is desirable to provide this device with the ability for a user to control the amount of steam so that a small amount of cleaning agent is injected into the steam without lowering the quality of the steam making the device suitable for cleaning household items.

SUMMARY OF THE INVENTION

Generally speaking, in accordance with the invention, a liquid dispensing unit suitable for injecting a controlled amount of liquid, such as a liquid soap agent into the outlet of a steam cleaning device as steam is applied to an object to be cleaned is provided. The steam generating device includes a water reservoir with a heating element for generating steam that is controlled by a hand grip that regulates the amount of steam fed to a nozzle, rigid pipe or an appliance piece mounted on the pipe or nozzle. The liquid dispensing unit includes a liquid reservoir mounted on the hand grip with a user operated pump for controlling the amount of liquid dispensed into the steam pipe upstream of the steam outlet. In one embodiment, the liquid dispensing unit includes a mechanical pump having a chamber with a trigger connected to a piston that is biased away from the bottom of the chamber by a spring. When the user depresses the trigger, the piston is pushed against the spring injecting liquid into the steam pipe. When the piston is released and moves back to its original position, additional fluid is drawn from the storage tank into the chamber.

Accordingly, it is an object of the invention to provide an improved liquid dispensing unit.

Another object of the invention is to provide an improved liquid dispensing unit for a steam cleaner for controlling the amount of liquid injected into the steam outlet.

A further object of the invention is to provide an improved liquid dispensing unit for a steam cleaner where a user controls the amount of steam and liquid cleaning agent dispensed in the steam outlet or nozzle.

Yet another object of the invention is a liquid cleaning dispensing unit that can be selectively added to a hand-held steam cleaning hand grip.

Yet a further object of the invention is to provide a liquid cleaning dispensing unit that allows addition of steam cleaning appliances.

Still other objects and advantages of the invention will in part be obvious and will in part be apparent from the specification.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is made to the following description taken in connection with the accompanying drawing(s), in which.

DETAILED DESCRIPTION OF THE INVENTION

Figure 1:
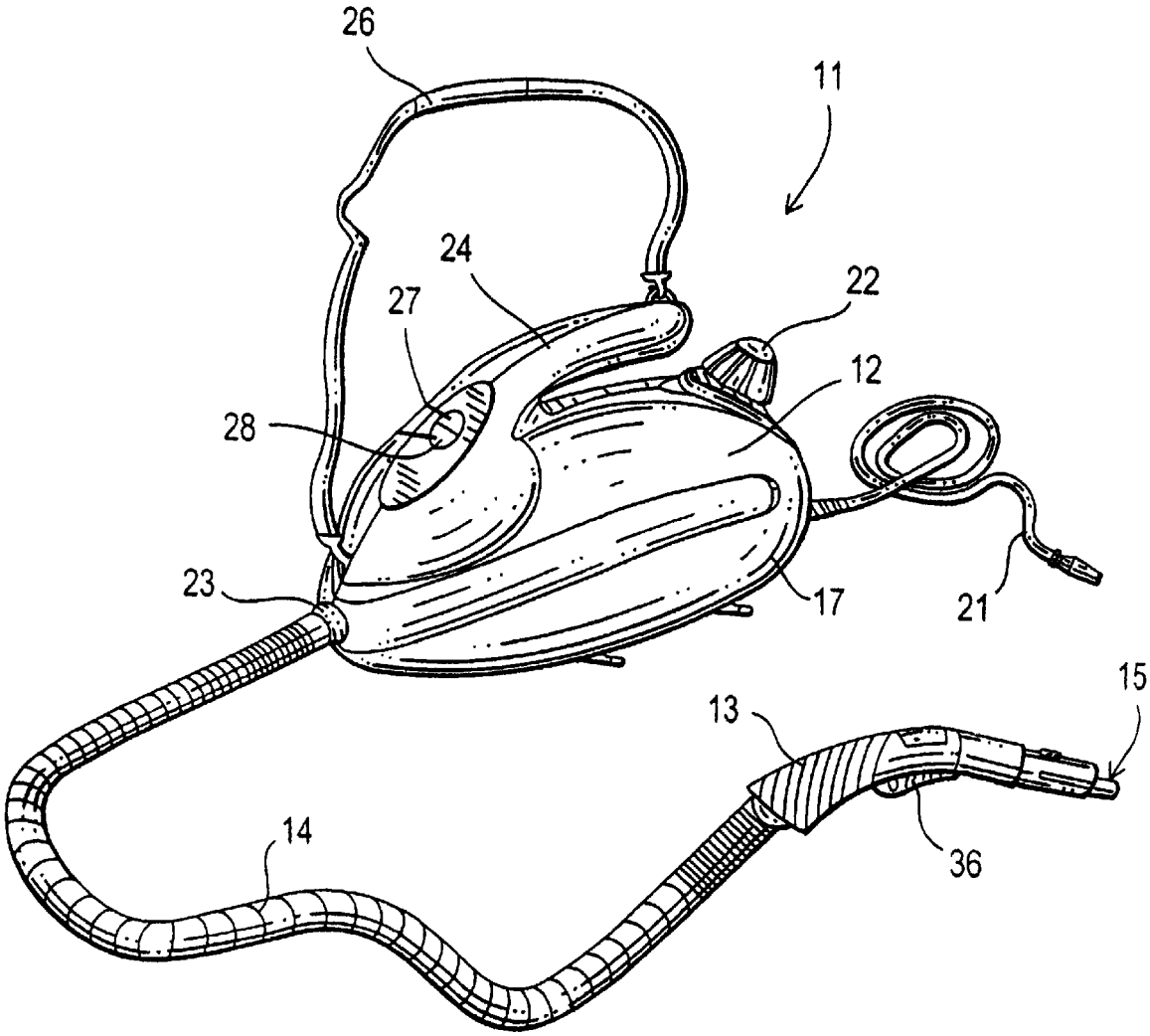
FIG. 1 is a perspective view of a steam cleaning device suitable for use with a liquid dispensing unit in accordance with the invention.
Figure 2A:
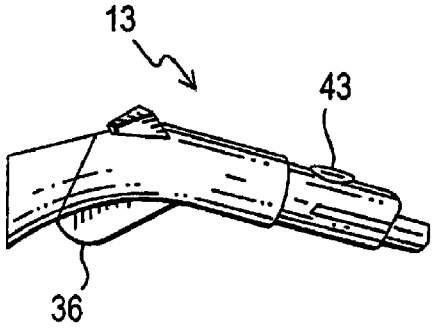
FIGS. 2*a* and 2*b* are perspective views of the hand grip of the steam cleaner of FIG. 1 showing the locking button and how an appliance is attached.
Figure 2B:
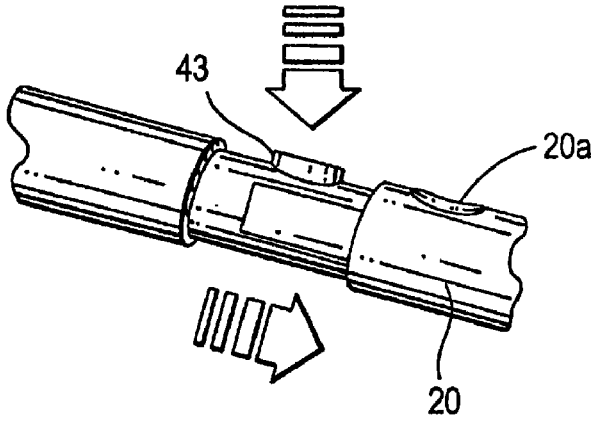

FIG. 1 is a perspective view of a steam cleaning device 11 including a main body 12 and a steam release hand grip 13 coupled to main body 12 by a flexible hose 14 and a steam outlet 15. A liquid dispensing attachment 51 is mounted on the distal nozzle end of hand grip 13 (see FIG. 6). Liquid dispensing device 51 includes a steam inlet 19 at the proximal end, a liquid reservoir 57 mounted on the bottom, and a steam outlet 51*b* for dispensing steam mixed with liquid stored in reservoir 57. Outlet 51*b* is the same configuration as outlet 15 to hand grip 13 that will be described in more detail in connection with hand grip 13 shown in detail in FIG. 2. This allows for installation of the same attachments, such as brushes and nozzle, to dispensing device 51 as outlet 51*b* of hand grip 13.

Main body 12 of steam cleaning device 11 includes a water inlet 22 and an internal water reservoir 17 with heating elements connected to a power source by a power cord 21. Steam generated in reservoir 17 exits by steam outlet 23 with flexible hose 14 coupled thereto. Main body 12 is outfitted with a handle 24 and a strap 26 for conveniently lifting and carrying main body 12. Main body 12 also includes an on/off switch 27 and an indicator light 28 to indicate when steam temperature is appropriate for use.

Figure 3:
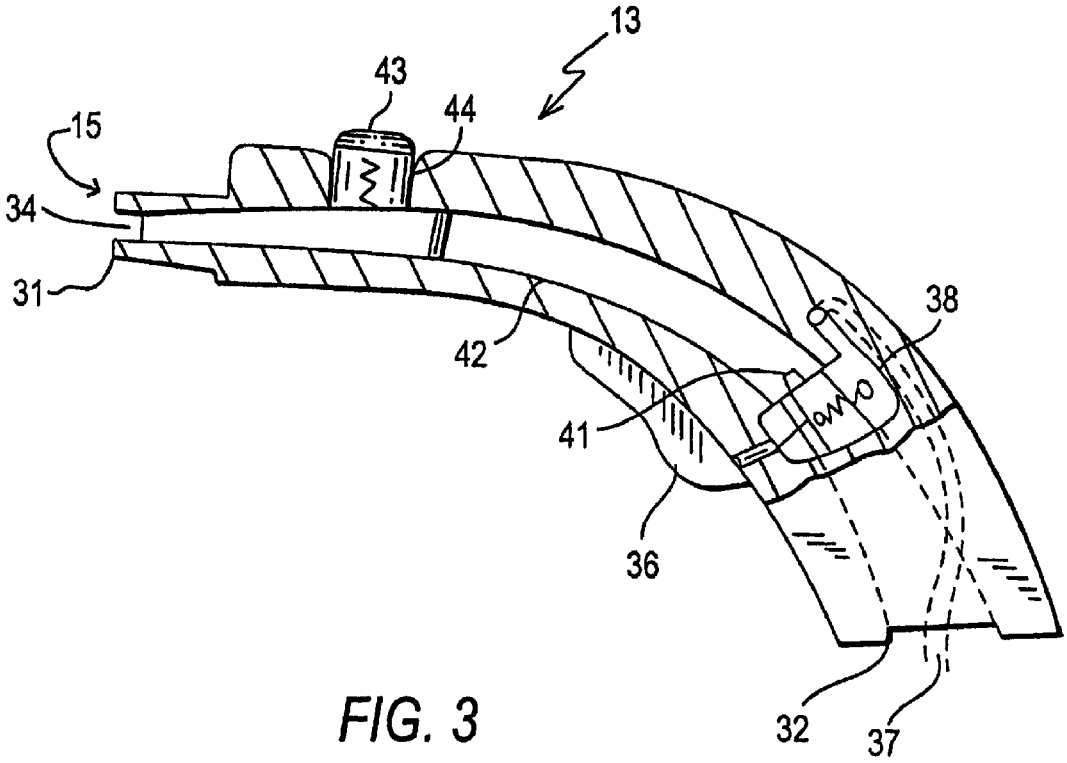
FIG. 3 is a cross-sectional view of the hand grip of FIG. 2.

Once water has been heated sufficiently to generate steam within main body 12, a user may selectively release steam by operation of hand grip 13. Hand grip 13 is illustrated in more detail in FIG. 2*a* and in cross-section in FIG. 3. Hand grip 13 has an internal cavity 34, and is elongated and curved for conveniently fitting within the hand of a user. Hand grip 13 includes a proximal inlet end 32 having a fitting for securing flexible hose 14 and a distal outlet end 31 for securing a nozzle or additional attachments, such as brushes or nozzles. In accordance with the invention, liquid cleaner dispenser 51 is mounted in the same manner as will be described in more detail below.

Hand grip 13 is fitted with a trigger 36 for selectively releasing and controlling the amount of steam fed to outlet end 31. In connection with the type of steam cleaner 11 set forth for purposes of illustration, steam generated by main body 12 passes through a steam conduit 37 coupled to a valve 38 within cavity 34 operated by squeezing trigger 36. When trigger 36 is squeezed, steam in conduit 37 passes through valve 38 and is released through a valve outlet 41 and a steam outlet conduit 42 that extends to outlet end 31.

A spring tab 43 is located at the distal end of hand grip 13 for allowing attachments to be placed at outlet end 31 and secured to hand grip 13. Tab 43 is positioned within an opening 44 in the upper portion of hand grip 13 and biased upwardly to extend above the upper surface of hand grip 13. Tab 43 is configured to fit within a corresponding opening within an attachment. This is illustrated and described in more detail in connection with an attachment such as a hose 20 having a button hole 20*a* shown in FIG. 2*b* for receiving tab 43.

Figure 4:
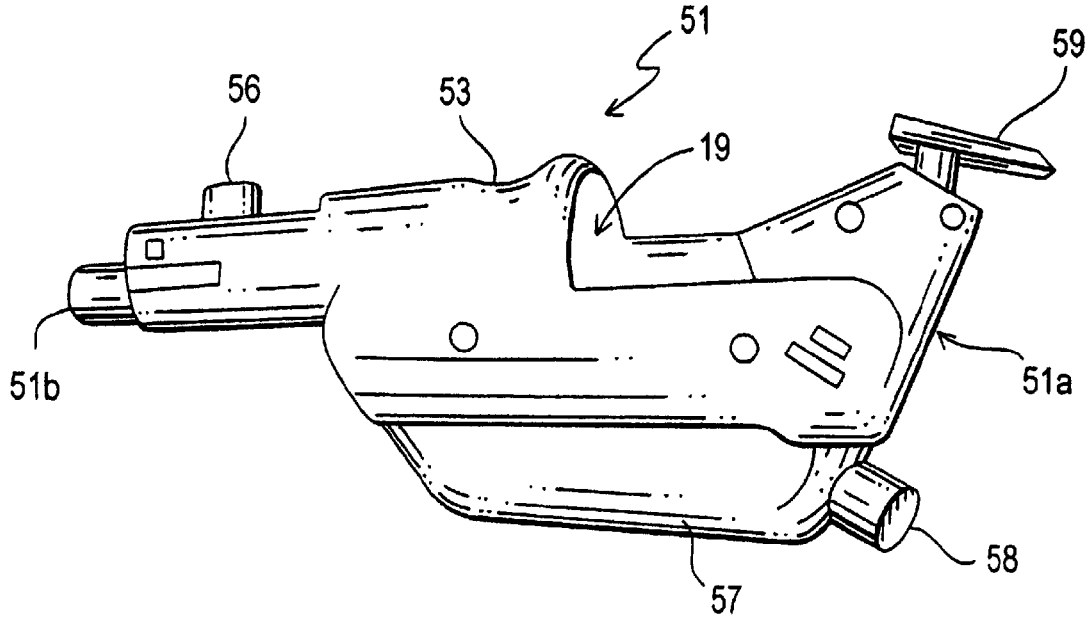
FIG. 4 is a perspective view of a liquid dispensing unit constructed and arranged in accordance with the invention.

Referring now to FIG. 4, a liquid dispensing unit 51 constructed and arranged in accordance with the invention is shown. Dispensing unit 51 is elongated, formed of substantially rigid plastic material having a proximal inlet end 51*a* and a distal outlet end 51*b*, and has a button hole 53 to engage locking tab 43 on distal end of hand grip 13. Unit 51 is formed with a proximal inlet end 51*a* for receiving distal end 31 of hand grip 13 with tab 43 fitting into a hole 53 formed at the top of unit 51 to engage unit 51 on hand grip 13 so the units will function as one. Unit 51 is formed with a distal outlet end and nozzle connection 51*b* that is identical with distal nozzle end 15 of hand grip 13. This allows addition of additional cleaning attachments, such as brushes and hoses or rigid pipes to distal outlet end 51*b* of unit 51. In this case, when liquid soap is dispensed into steam exiting outlet end 51*b*, it will then pass through the additional cleaning attachments mounted thereon.

Figure 5:
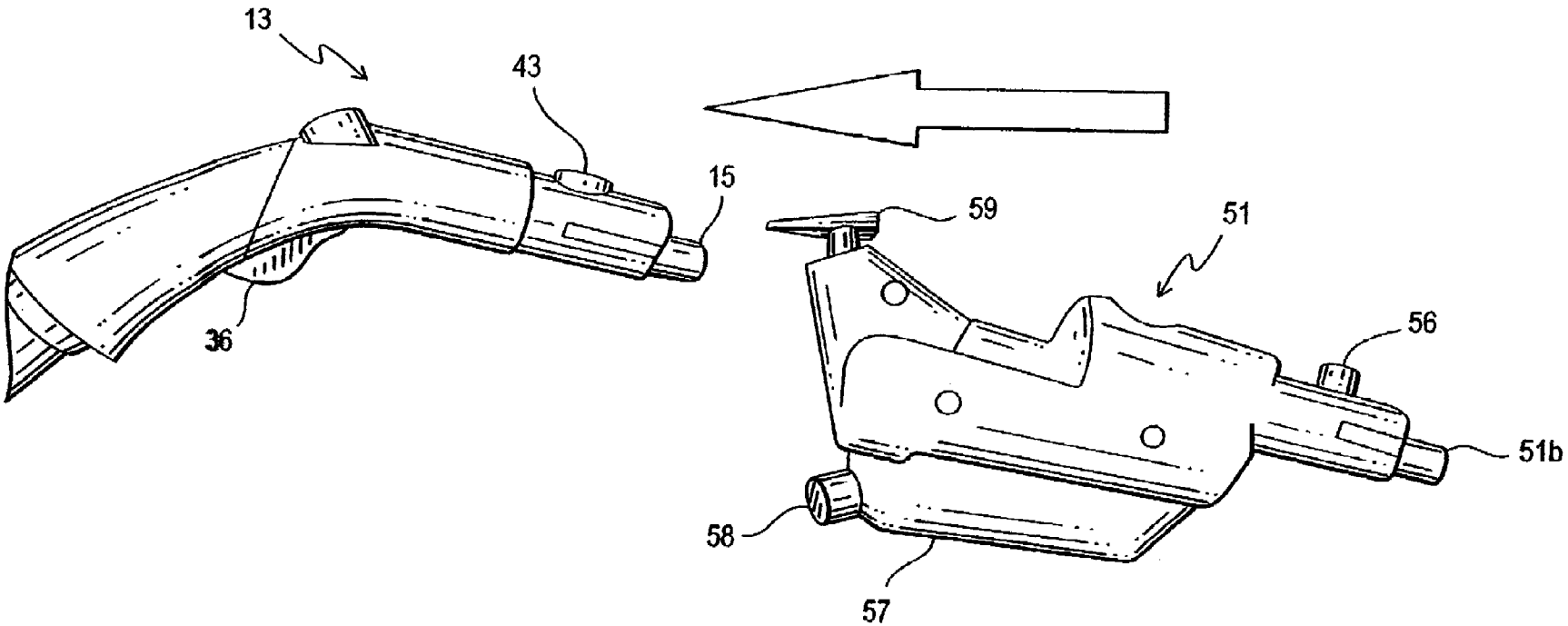
FIG. 5 is a perspective view of the liquid dispensing unit of FIG. 4 and how it attaches to the hand grip of FIG. 3.
Figure 6:
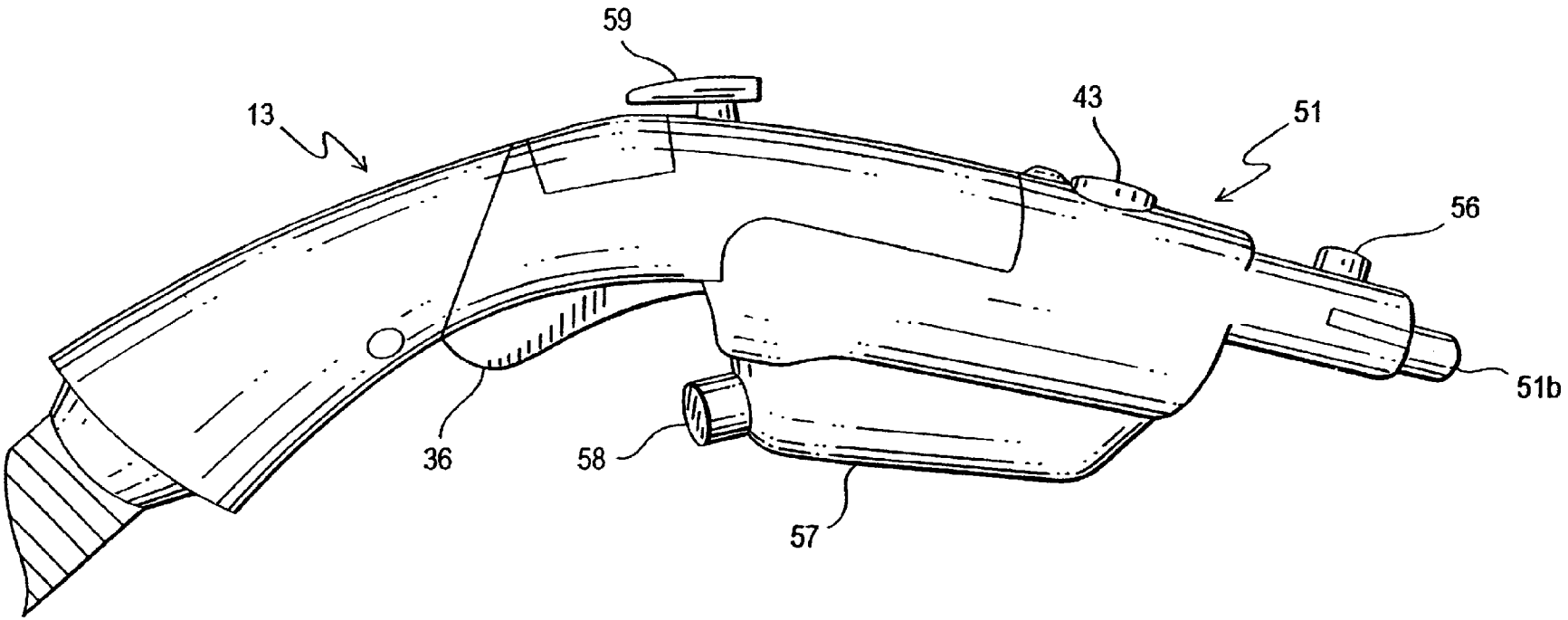
FIG. 6 is a perspective view of the liquid dispensing unit of FIG. 4 attached to the steam cleaner hand grip.

FIG. 5 shows how liquid dispensing unit 51 is attached to locking button 43 of hand grip 13. Once attached as shown in FIG. 6, locking button 56 on unit 51 is available for attaching a steam cleaning attachment of the same type that may be attached directly to hand grip 13. Suitable attachments include steam concentrators, bristle brushes, wallpaper scrapers, squeegees and the like. This makes the steam cleaner suitable for a wide variety of chores requiring the additional cleaning benefits of soap in combination with steam.

Figure 7:
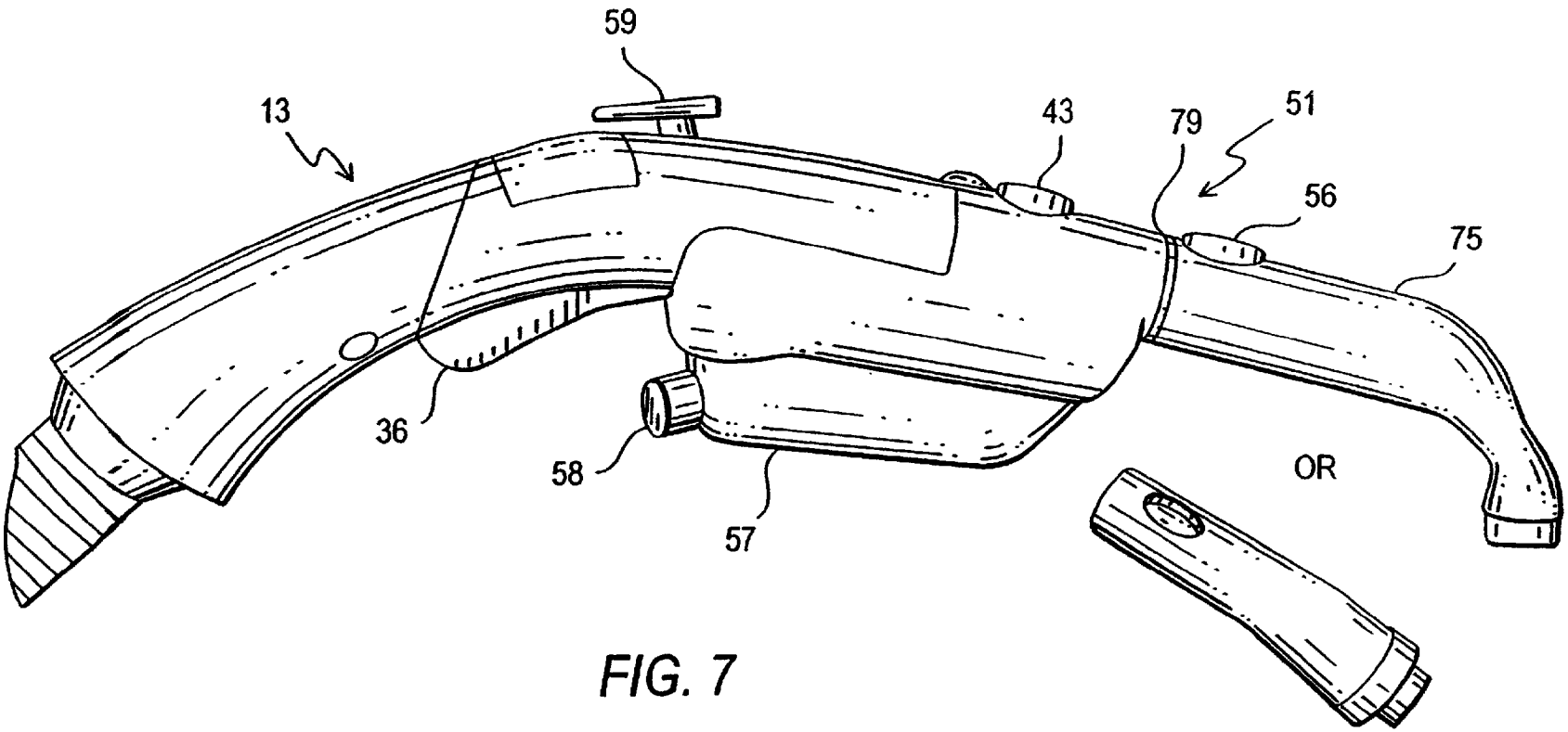
FIG. 7 is a perspective view of the hand grip and dispensing unit with an appliance attached to the liquid dispensing unit.

Locking projecting tab 56 is provided at distal end 51*b* of unit 51 for providing the locking engagement mechanism with these attachments. FIG. 7 shows one embodiment of the present invention where a bristle brush attachment 75 is mounted on liquid dispensing unit 51, which is mounted on stream hand grip 13. Brush attachment 75 has an opening 79 configured to engage locking tab 56 on the distal end 51*b* of the liquid dispensing unit 51.

In accordance with the invention, unit 51 includes a liquid reservoir tank 57, in this case positioned at the bottom of unit 51, with a removable cap 58 for adding liquid cleaning fluid to reservoir 57. Unit 51 has a user operable release pump button 59 for injecting liquid stored in reservoir 57 into steam passing through a conduit 61 in liquid dispensing unit 51. Operation of pump button 59 will be described in detail in connection with FIG. 8.

Figure 8:
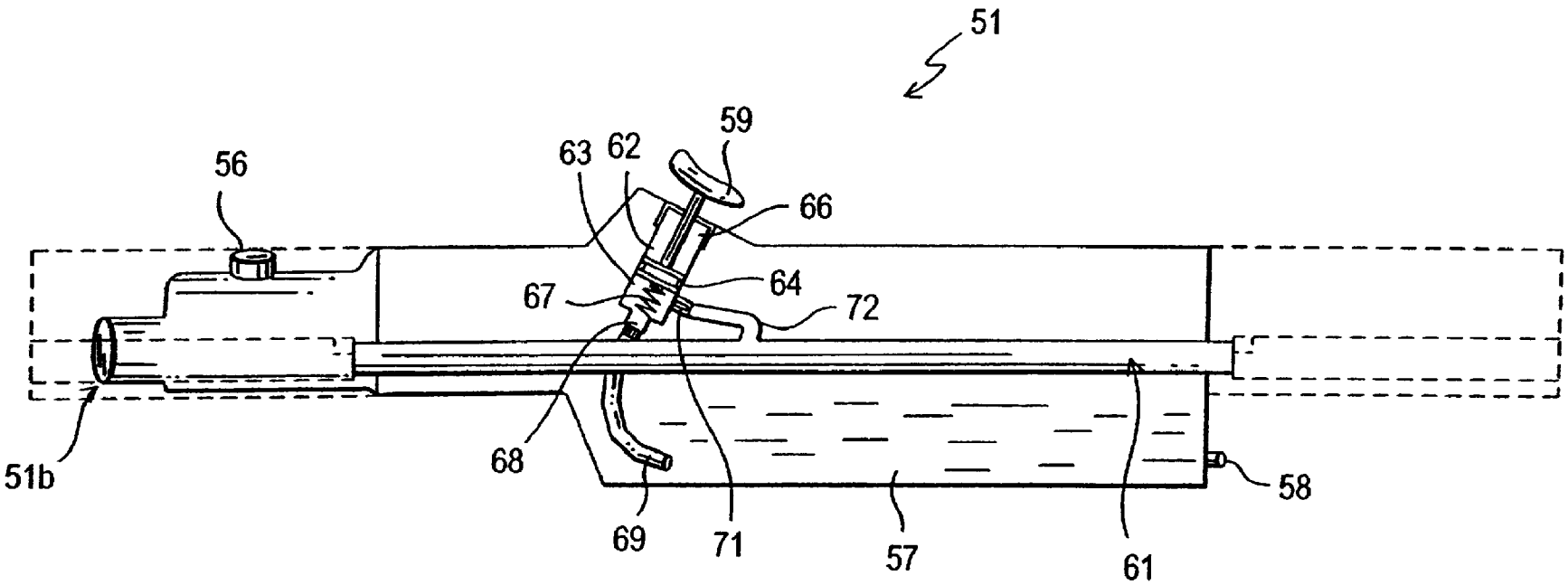
FIG. 8 is a schematic cross-sectional elevational view of a liquid dispensing unit constructed and arranged in accordance with the invention to be mounted on a steam cleaner hand grip of the type shown in FIG. 1.

FIG. 8 shows in schematic a cross-sectional view of liquid dispensing unit 51 illustrated in FIG. 4. Steam allowed to exit hand grip 13 passes through elongated passageway 61 to nozzle end 54. Pump button 59 of liquid dispensing unit 51 is operatively coupled to a pump 62 having a cavity 63 and a piston 64 connected to button 59 by a shaft 66. A spring 67 is positioned within cavity 63 biasing piston 64 upwardly. A one-way inlet valve 68 is located at the lower end of cavity 63 with an inlet conduit 69 extending from reservoir 57. An one-way outlet valve 71 is located in the sidewall of cavity 63. An outlet conduit 72 connects one-way outlet valve 71 to steam conduit 61. This control is mechanical; however, it is within the scope of the invention to utilize electrical controls.

During operation, after button 59 is depressed and released, spring 67 biases piston 64 upwardly to fill cavity 63 with liquid from reservoir 57. When it is desired to inject cleaning fluid into conduit 61 to mix with the steam, button 59 is depressed forcing liquid cleaning fluid out outlet one-way valve 71 through conduit 72 into steam conduit 61. Here, liquid cleaning fluid from cavity 63 is injected into steam passing to outlet 51*b* directly onto the surface to be cleaned or through an optional attachment coupled thereto.

The diameter of the proximal end of conduit 61 of the liquid dispensing unit 51 is larger than the passageway 42 of the steam hand grip attachment 13 so that a tight connection can be formed between the conduit 61 of the liquid dispensing unit 51 and the passageway 42 of the steam hand grip attachment 13. A secure locking engagement of tab 56 with a spring allows a variety of cleaning nozzles to be engaged to the liquid dispensing unit 51 when assembled for use.

The liquid in reservoir 57 to be injected into the steam may be any suitable liquid cleaning agent such as soap or solvent, preferably, the liquid soap is fully miscible with water and bio-degradable. The solvents include cleaning solutions and degreasers.

Liquid dispensing unit provides many advantages over known steam cleaning devices. Here, a controlled and small amount of soap is selectively added to the steam outlet. This allows the surface to be steamed initially, soaped and steam added for increased cleaning, and then the soap rinsed from the cleaned surface by steam alone. The internal mechanism of the hand grip does not encounter the soap that is slowly injected into the steam being fed to the nozzle, pipe or appliance attached to the hand grip. Thus, there is no potential to clog or foul the steam release trigger mechanism. By injecting small amounts of liquid soap, the temperature and quality of the steam are not lowered.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

The present invention may be embodied in other specific forms without departing from the spirit or essential attributes of the invention. Accordingly, reference should be made to the appended claims, rather than the foregoing specification, as indicating the scope of the invention.

What is claimed is:

1. A liquid dispensing unit, comprising:

a housing with a fluid passage therethrough;

at least one liquid storage reservoir mounted on the housing;

a pump having an inlet conduit connected to the reservoir and an outlet conduit connected to the fluid passage, the pump including a cylindrical chamber and a piston operatively displaceable in the chamber in response to movement of the pump button on to release fluid into the fluid passage and the pump chamber including a first one-way valve between the chamber and the inlet conduit, and a second one-way valve between the chamber and the outlet conduit;

the inlet conduit for conveying the liquid from the storage reservoir to the pump, and the outlet passage for injecting liquid into the fluid in the fluid passage; and a pump button coupled to the pump for controlling the amount of liquid dispensed through the outlet conduit into the fluid passage.

2. The liquid dispensing unit of claim 1, wherein the liquid is a cleaning agent.

3. The liquid dispensing unit of claim 1, wherein the fluid passage carries steam.

4. The liquid dispensing unit of claim 1, wherein the housing includes a locking tab attachment for receiving attachments to the distal end thereof.

5. The liquid dispensing unit of claim 1, wherein the housing is adapted to engage a hand grip of a steam cleaner.

6. The liquid dispensing unit of claim 5, wherein the steam hand grip includes a trigger for controlling the amount of steam passing through the fluid conduit.

7. The liquid dispensing unit of claim 5, wherein the distal end of the housing includes a locking tab for selectively receiving steam cleaning attachments.

8. A liquid dispensing unit for a steam hand grip attachment of a steam cleaner, comprising:

an elongated housing having a proximal inlet end and distal outlet end with a fluid conduit extending therethrough;

the inlet end configured to receive the steam outlet end of the steam cleaner;

a liquid reservoir mounted on the housing;

a pump mounted on the housing with an inlet conduit connected to the fluid conduit, the pump including a cylindrical chamber and a piston operatively displaceable in the chamber in response to movement of the pump button to release fluid into the fluid passage and the pump chamber including a first one-way valve between the chamber and the inlet conduit, and a second one-way valve between the chamber and the outlet conduit; and a pump button for controlling the amount of liquid dispensed through the outlet conduit to the fluid conduit.

9. A steam cleaner including a liquid dispensing unit, comprising:

a main body having a heating element, a water inlet and a steam outlet, and a steam hose connected to the outlet and a steam hand grip mounted on the distal end of the hose;

a liquid dispensing unit mounted on the steam hand grip, the liquid dispensing unit including: a housing with a fluid passage therethrough;

at least one liquid storage reservoir mounted on the housing;

a pump having an inlet conduit connected to the reservoir and an outlet conduit connected to the fluid passage, the pump including a cylindrical chamber and a piston operatively displaceable in the chamber in response to movement of the pump button to release fluid into the fluid passage and the pump chamber including a first one-way valve between the chamber and the inlet conduit, and a second one-way valve between the chamber and the outlet conduit;

the inlet conduit for conveying the liquid from the storage reservoir to the pump, and the outlet passage for injecting liquid into the fluid in the fluid passage; and a pump button coupled to the pump for controlling the amount of liquid dispensed through the outlet conduit into the fluid passage.

10. The steam cleaner of claim 9, wherein the liquid in the liquid dispensing unit is a cleaning agent.

11. The steam cleaner of claim 9, wherein the fluid passage carries steam.

12. The steam cleaner of claim 9, wherein the housing includes a locking tab attachment for receiving attachments to the distal end thereof.

* * * * *